US006189594B1

(12) United States Patent
Carter

(10) Patent No.: US 6,189,594 B1
(45) Date of Patent: Feb. 20, 2001

(54) PORTABLE DISPLAY CASE

(76) Inventor: Wallace T. Carter, 118 Holiday Hills Dr., Wilmington, NC (US) 28409

( * ) Notice: Under 35 U.S.C. 154(b), the term of this patent shall be extended for 0 days.

(21) Appl. No.: 09/296,290

(22) Filed: Apr. 22, 1999

(51) Int. Cl.[7] ..... A47G 5/00
(52) U.S. Cl. ..... 160/135
(58) Field of Search ..... 160/135, 351, 160/352; 40/605, 606, 610; 52/239, 238.1

(56) References Cited

U.S. PATENT DOCUMENTS

| | | | | |
|---|---|---|---|---|
| 2,549,306 | | 4/1951 | Greene . | |
| 2,707,538 | | 5/1955 | Mayer, Sr. et al. . | |
| 3,297,118 | | 1/1967 | Skyhawk et al. . | |
| 3,938,772 | * | 2/1976 | Andrusiak | 40/605 X |
| 4,147,198 | * | 4/1979 | Ytter | 160/135 |
| 4,524,852 | | 6/1985 | Hess . | |
| 4,678,018 | * | 7/1987 | Grundstedt et al. | 160/135 |
| 4,785,565 | * | 11/1988 | Kuffner | 160/135 |
| 4,833,802 | | 5/1989 | Volkert . | |
| 4,852,498 | | 8/1989 | Judd . | |
| 4,893,711 | | 1/1990 | Gustafson . | |
| 5,220,952 | * | 6/1993 | Beaulieu | 160/135 |
| 5,439,043 | | 8/1995 | Carter . | |
| 5,791,391 | | 8/1998 | Carter . | |

* cited by examiner

*Primary Examiner*—David M. Purol
(74) *Attorney, Agent, or Firm*—Diller, Ramik & Wight, PC

(57) ABSTRACT

A portable display case includes two centermost and two outermost panel members mounted for pivotal movement relative to each other between panel face-to-panel face opposing relationship in substantially parallel planes in a closed position and in substantially side-by-side relationship in an open position. A carrying handle is mounted for reciprocal sliding movement relative to one of the panel members to permit the portable display case to be carried much in the manner in a briefcase or an attaché case. The outermost panels are each of an identical construction and the innermost or centermost panels are each of an identical construction providing interchangeability thereof. To the latter end, latches associated with side edges of the outermost panels are in asymmetrical relationship to each other. The centermost panel members also include recesses into each or both of which can be inserted a header in the closed position of the display case while upper edges of the centermost panel members have recesses or accommodating feet of the header in the display position.

71 Claims, 6 Drawing Sheets

10

130
131
132
146
134
144
61, 62
133
12, 13
150
147
135
145

PORTABLE DISPLAY CASE

BACKGROUND OF THE INVENTION

This invention relates to a display system which is portable, free-standing, and can be packed, unpacked and/or repacked, transported and utilized readily for display purposes at sales presentations, conventions, seminars or the like.

Conventional display systems normally provide a relatively large display surface formed by a number of display panels which are supported by a frame or are themselves self-supporting. Such display systems are relatively large and the individual components are normally packed in a tubular carrier for transportation and storage. Larger displays can be reconfigured into smaller displays for table top presentations, but no display is specifically so designed as to be relatively small or compact in size for ready transport and subsequent utilization as a table top or desk top display.

Examples of conventional display systems of the type aforesaid include those disclosed in U.S. Pat. No. 5,439,043 granted on Aug. 8, 1995, U.S. Pat. No. 5,611,384 granted on Mar. 18, 1997 and U.S. Pat. No. 5,791,391 granted on Aug. 11, 1998, each in the name of Wallace T. Carter.

U.S. Pat. No. 4,893,711 issued to Gustafson is not directed to a display or a portable display case, but discloses a so-called convertible carrying case and expandable easel which includes four relatively slidable panels shown best in FIG. 3 in the open position of the carrying case, as compared to the closed position of FIG. 1 and the partially open position of FIG. 2. The carrying case is hinged to open and close between the position shown in FIGS. 1 and 2, and two arms are used as a carrying handle (FIG. 1) and as supporting stands (FIG. 4). Latches (FIG. 1) hold the two case halves or panels closed. This patent reflects the closest prior art developed during a search of the present invention, but will be seen to lack the novel structure disclosed and claimed herein.

U.S. Pat. No. 4,524,852 issued to Hess also discloses a changeable sample case which includes three panels pivoted to each other which when closed define a display case (FIG. 1) which can be opened (FIG. 3) and supported upright for display purposes.

U.S. Pat. No. 3,297,118 issued to Van Skyhawk et al. is another example of a carrying case and a display case in which a handle can be basically pushed, pulled or slid between its carrying position (FIGS. 1 and 2) and eventually pivoted and interlocked in a display position (FIG. 6).

Other patents found during the search of the present invention and which are considered of lesser interest and/or disclose equivalent or redundant structure corresponding to structure disclosed in the above-described patents include the following:

| | |
|---|---|
| Greene | U.S. Pat. No. 2,549,306 |
| Mayer, Sr. et al. | U.S. Pat. No. 2,707,538 |
| Volkert | U.S. Pat. No. 4,833,802 |
| Judd | U.S. Pat. No. 4,852,498 |

SUMMARY OF THE INVENTION

A novel portable display of the present invention includes a portable display case formed of a plurality of panel members with adjacent panel members being pivotally connected to each other. The portable display case preferably includes four such panel members with each panel member having upper and lower substantially parallel edge portions and opposite substantially parallel side edge portions with side edge portions of adjacent panel members being pivotally connected to each other for movement between a closed position in which panel faces of the panel members are in substantially panel face-to-panel-face opposing relationship in substantially parallel planes and an open display position in which the panel members are in substantially side-by-side and/or aligned relationship. One of the panel members, preferably one of two centermost panel members, includes a reciprocally slidable carrying handle which is moved between an inoperative housed position and an operative carrying position which allows the portable display case to be carried much in the manner of an attaché case or the like. The carrying handle preferably includes a pair of legs and a hand grip therebetween. The pair of legs are mounted for reciprocal sliding movement in an associated panel member, and stops prevent the carrying handle from being bodily removed from its associated panel member.

The portable display case also includes slots along upper edges of preferably the centermost two panel members which receive projections or legs of a header which allows the header to be supported in an upright position relative to the centermost panel members in the display position.

At least a rear face of one of the panel members includes a recess configured to the shape of the header for housing the header during transport. Preferably, the centermost two panel members have recesses corresponding in shape to the header which are opposite mirror images of each other and thereby collectively define a single recess accommodating the header when the two centermost panel members are moved to their closed position.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figures 1, 2:
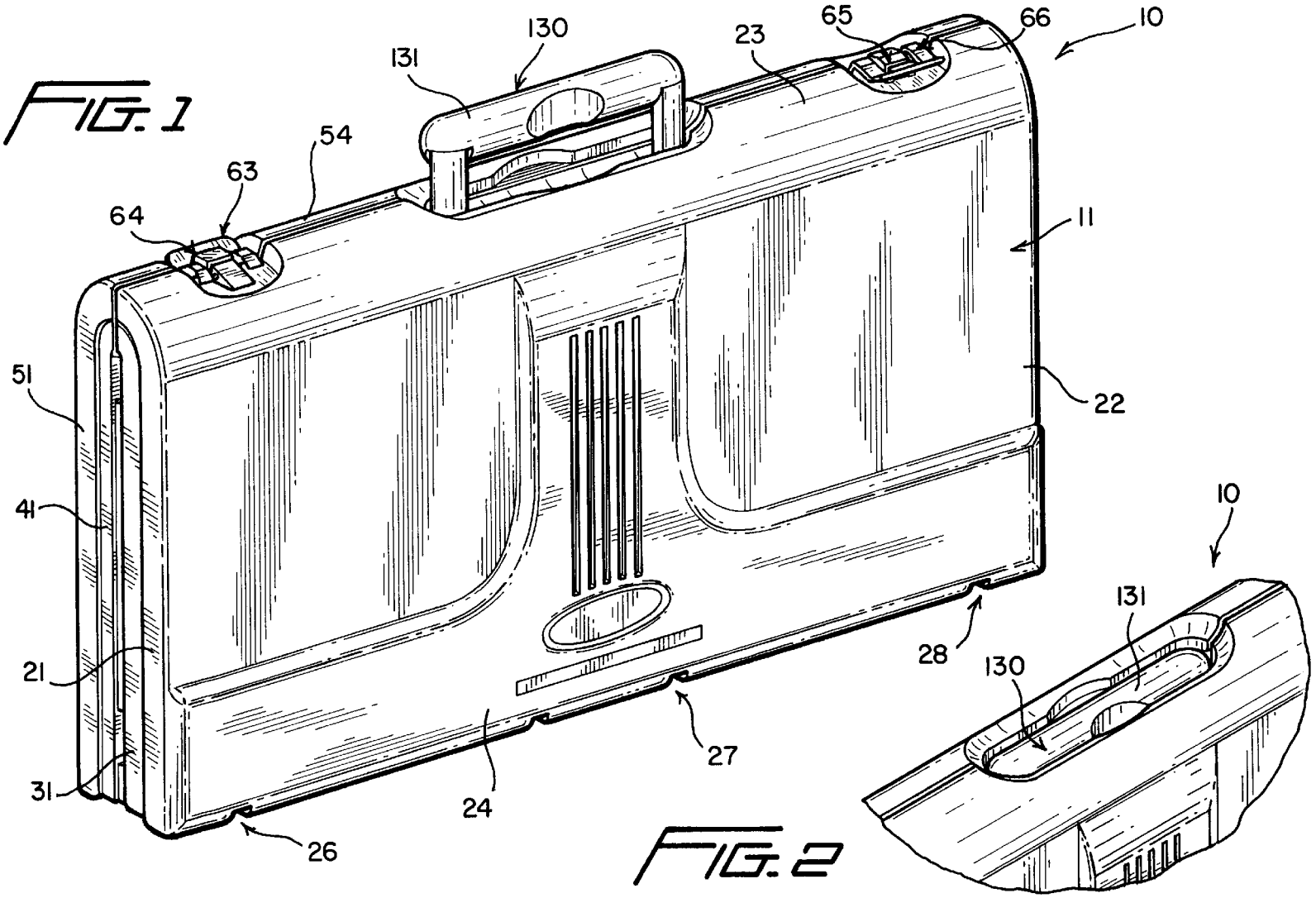
FIG. 1 is a perspective view of a novel portable display case constructed in accordance with the invention, and illustrates the closed position thereof with a carrying handle extended to its carrying position.
FIG. 2 is a fragmentary perspective view of the handle carrying area of the portable display case, and illustrates the handle in its retracted or stored position.

A novel portable display case constructed in accordance with this invention is fully illustrated in the drawings and is generally designated the reference numeral 10 (FIGS. 1, 3, 4 and 5).

Figure 3:
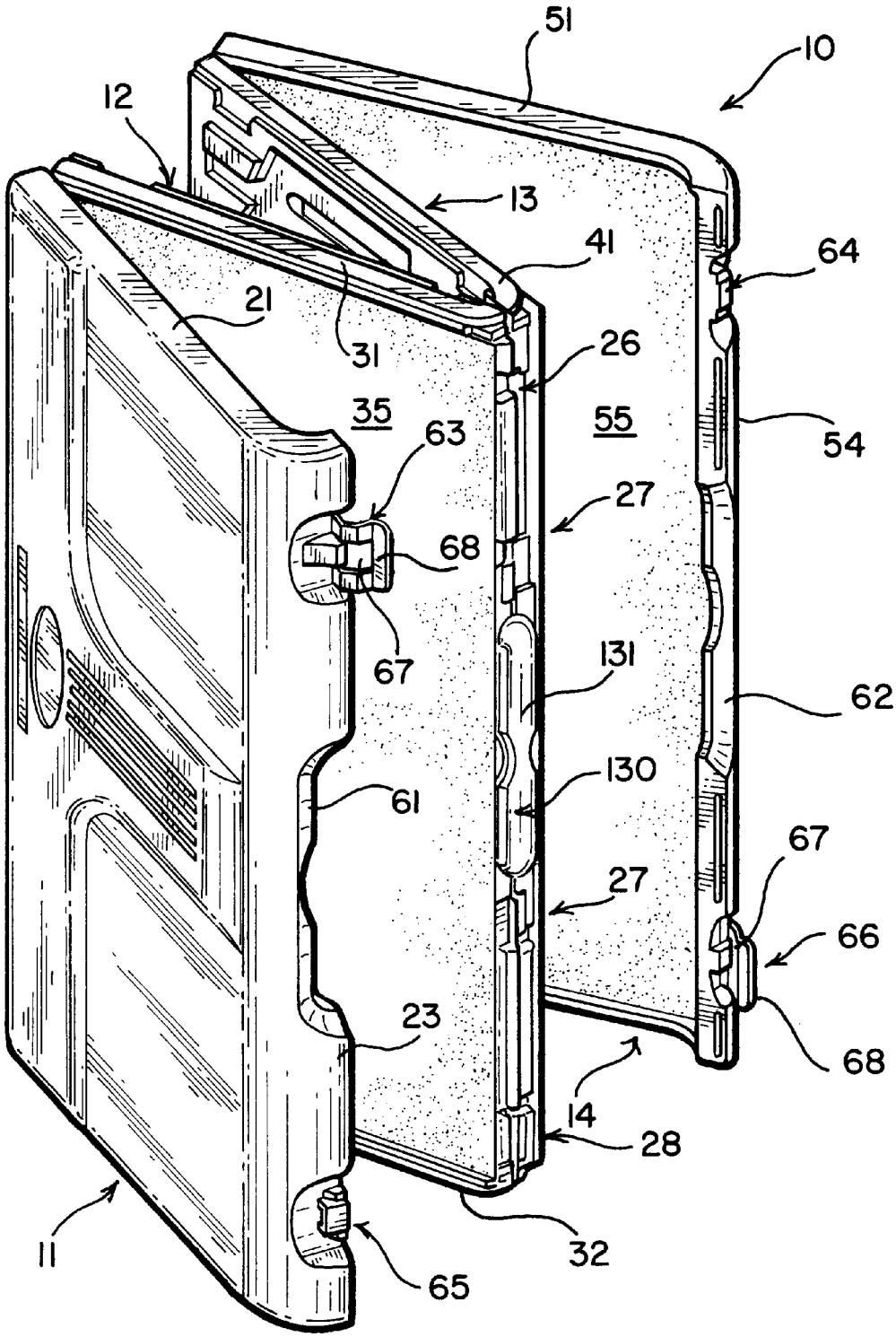
FIG. 3 is a perspective view of the portable display case of FIG. 1, and illustrates four panel members thereof united by pivots about which the panel members have been partially opened toward a display or use position.
Figure 4:
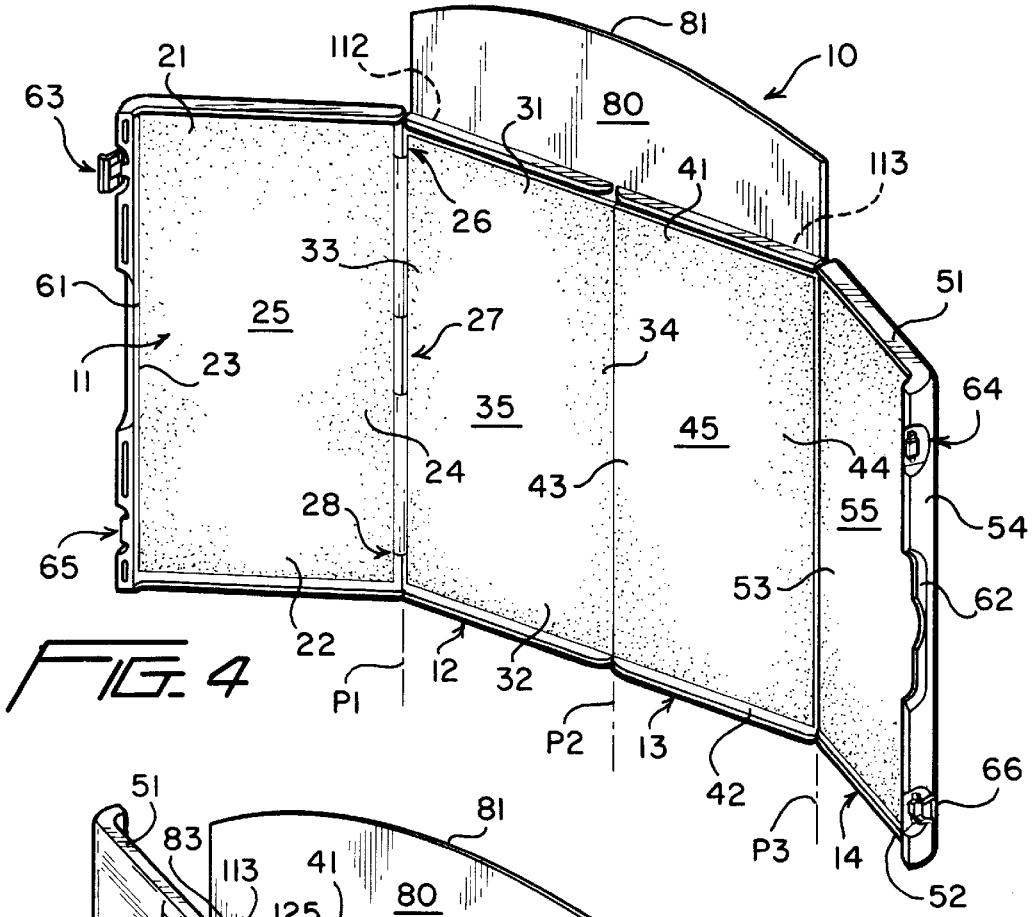
FIG. 4 is a front perspective view of the portable display case, and illustrates the display position thereof with a central pair of the panel members being substantially in coplanar relationship and a header secured in spanning relationship to the centermost panel members.
Figure 5:
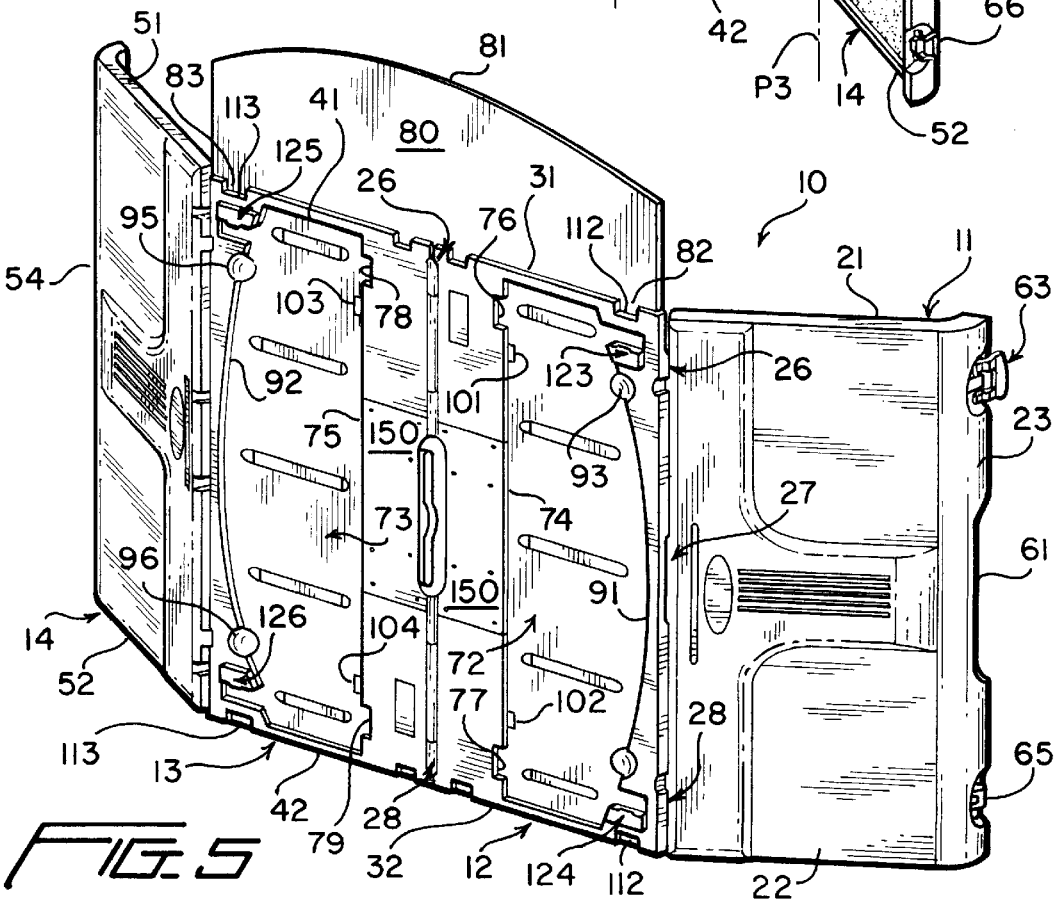
FIG. 5 is a rear perspective view of the portable display case in the same position as that illustrated in FIG. 4, and illustrates a header receiving recess in each of the two centermost panel members corresponding to the configuration of the header into which the header can be inserted and stored in the closed position of the display case.

The portable display case 10 includes a plurality of panel members, and in a preferred embodiment of the invention, four such panel members 11 through 14 are illustrated in a closed carrying or transporting position (FIG. 1), a partially opened position (FIG. 3) and an open or display position (FIGS. 4 and 5).

Each of the panel members 11 through 14 is of a hollow construction formed from polymeric/copolymeric synthetic plastic material in a conventional manner which lessens the weight of the overall portable display case 10 while at the same time increasing the rigidity thereof.

The panel member 11 is in an outermost, outer or exterior panel member and includes an upper edge or edge portion 21, a lower edge or edge portion 22 substantially parallel to the upper edge portion 21, and opposite generally parallel side, edges or side edge portions 23, 24 (FIG. 4).

The panel member 12 likewise includes an upper edge or edge portion 31 substantially parallel to a lower edge or edge portion 32 and opposite substantially parallel side edges or side edge portions 33, 34.

The panel member 13 includes an upper edge or edge portion 41, a lower edge or edge portion 42 substantially parallel thereto, and opposite generally parallel side edge portions 43, 44.

The panel member 14 is an exterior, outermost or outer panel member and includes upper and lower edges or edge portions 51, 52 disposed substantially parallel to each other, and opposite substantially parallel vertical side edges or edge portions 53, 54.

The front or "display" surfaces (not shown) of each of the panel members 11 through 14 are covered by a sheet of aesthetic fabric material or the like to define respective display panels 25, 35, 45 and 55 (FIG. 4).

The adjacent vertical edge portions 24, 33 (FIG. 4) of the adjacent panel members 11, 12 are pivotally connected together by upper pivot means 26, medial pivot means 27 and lower pivot means 28. Substantially identical pivot means 26, 27, 28 pivotally connect together the panels 13, 14 and 12, 13. The pivot means 26, 28 are essentially identical, and like identical pivot means pivotally connect together the side edge portions 34, 43 of the panel members 12, 13, respectively, and the side edge portions 44, 53 of the panel members 13, 14 at respective upper and lower edges thereof. Pivot means 27 are also located between the pivot means 26, 27 of the panel members 12, 13 and 13, 14. In this manner three substantially vertical pivot axes P1, P2 and P3 (FIG. 4) are provided about which the panel members 11 through 14 can selectively pivot between the fully closed or transport/carrying position of the portable display case (FIG. 1) to and through the partially open/closed position of FIG. 3 and the fully open or display position of FIGS. 4 and 5. It is to be noted from FIG. 3 that as the panel members 11 through 14 are moved toward the closed position of FIG. 1, the respective display panels or display surfaces 25, 35 and 45, 55 are progressively moved toward each other until brought into panel face-to-panel face opposing relationship in substantially parallel planes when the portable display case 10 is completely closed, as is readily visualized in FIG. 1 of the drawings. This same pivoting closing motion brings the rear surfaces (unnumbered) of the centermost two panel members 12, 13 into panel face-to-panel face opposing relationship, also in substantially parallel planes, for a purpose fully described further herein.

Figures 6, 7:
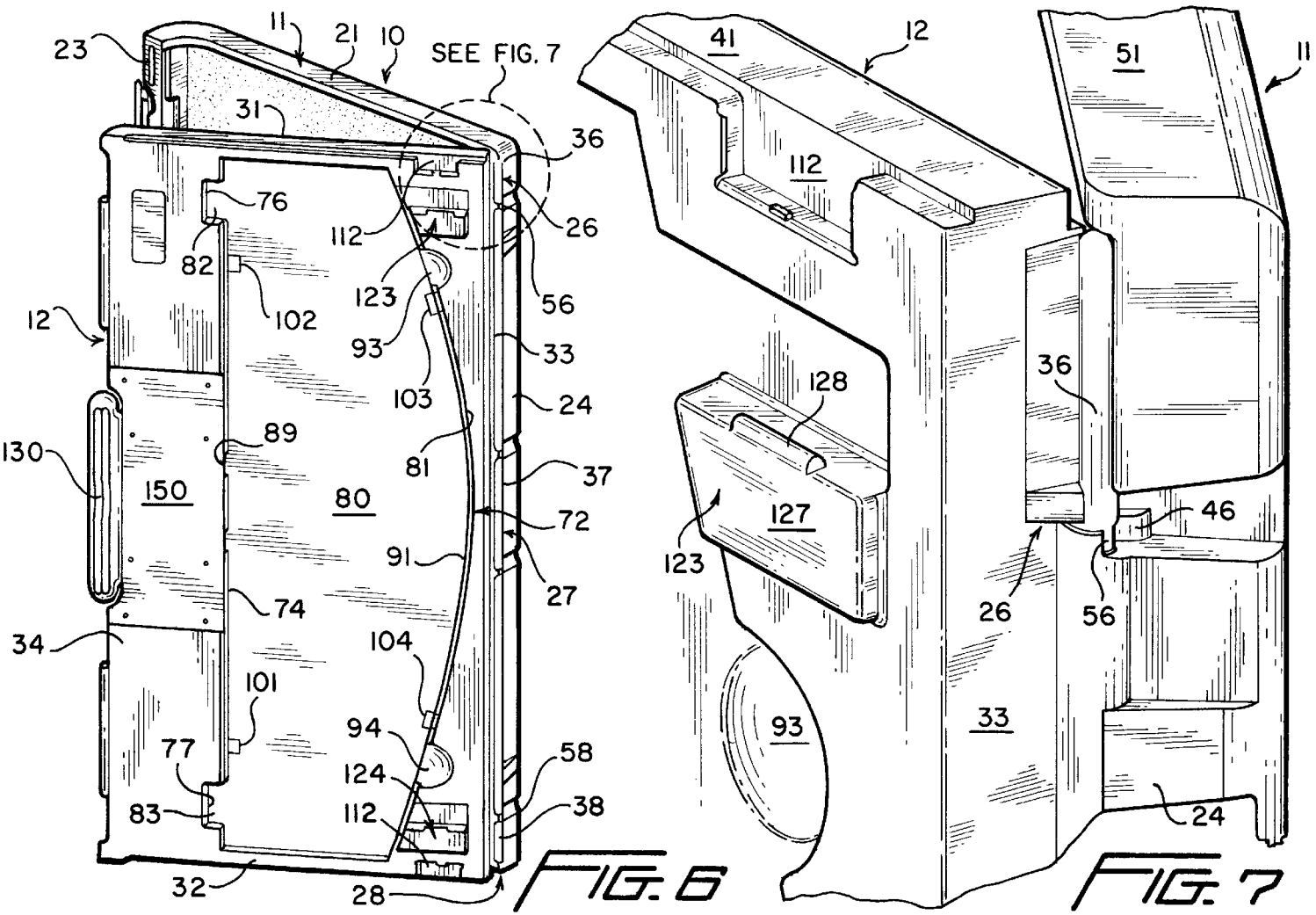
FIG. 6 is a perspective view of a portion of the portable display case, and illustrates one of the centermost panel members and the header inserted into the header receiving recess thereof.
FIG. 7 is a highly enlarged perspective view of the encircled portion of FIG. 6, and illustrates details of a pivot, a retaining slot for the header, a latch for securing the centermost panel members together, and a finger-receiving recess for facilitating the extraction of the header from its recess.
Figure 8:
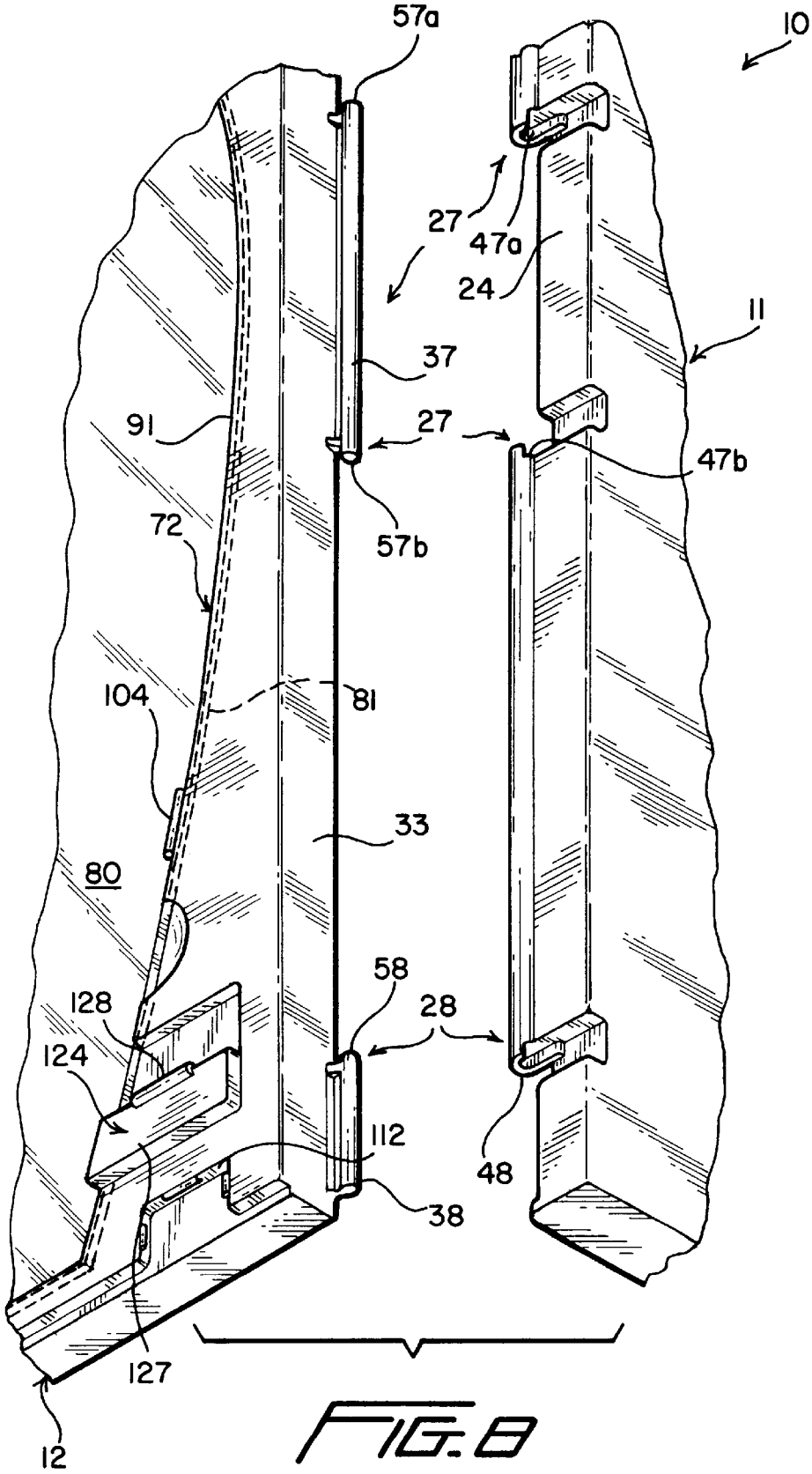
FIG. 8 is a fragmentary, enlarged, exploded view of lower corners of the two panel members of FIG. 6, and illustrates further details thereof including the pivots uniting the same.

As is best illustrated in FIGS. 6 through 8 of the drawings, each of the pivot means 26, 27 and 28 includes an integral pin 36 through 38 carried by the side edge portion 33 of the panel member 12 (and the side edge portion 44 of the panel member 13) and respective pin-receiving channels or recesses 46 (FIG. 7), 47*a*, 47*b* (FIG. 8), and 48 carried by the side edge 24 of the panel member 11 (and the side edge 33 of the panel member 14). The pivot pins 36, 38 have respective ends 56 (FIG. 7), 58 (FIG. 8) which project respectively downwardly and upwardly and are snapped-secured in and are retained by the respective pin-receiving channels 46, 48. The pin 37 (FIG. 8) includes oppositely projecting ends 57*a*, 57*b* (FIG. 8) which are snapped-received in the respective pin-receiving channels 47*a*, 47*b*. Because of the identical construction of the pivot means 26, 27 and 28, the panel members 11, 14 are interchangeable and when interchanged, the upper edge portions 21, 51 become the lower edge portions, while the lower edge portions 22, 52 become the upper edge portions. This interchangeability of the panel members 11, 14 is highly desirable because it requires but a single mold to form either of the end panel members 11, 14 which are essentially of an identical construction, thereby reducing the overall manufacturing costs.

In order to achieve the interchangeability of the panel members 11, 14, the symmetry thereof when essentially "rotated" or "flipped" 180° from that illustrated in FIGS. 4 and 5, must be maintained with respect to all other cooperative components, and to this end the side edges 23, 54 of the panel members 11, 14 are provided with centrally located handle grip receiving recesses 61, 62 and two sets of display case latches 63, 64 and 65, 66 (FIGS. 3 and 4). The latch components 63, 66 are flexible latching tongues, each having a rectangular opening 67 and a latching bar 68, whereas the components 65, 66 are each a generally polygonal latching projection or latching lip sized for receipt into the associated opening 67 of the latching tongues 63, 66. As is most evident in FIGS. 3 and 4 of the drawings, the positions of the latching tongues 63, 66 and latching projections 64, 65 are reversed relative tat the panel members 11 and 14, thus facilitating the fabrication of a single end panel member 11 or 14 in a mold for utilization as either of the panel members 11, 14.

Each of the panel members 12, 13 includes a respective header-receiving recess 72, 73 (FIG. 5) which are each of a configuration corresponding substantially identically to but slightly larger than the configuration of a "header" 80 (FIGS.

4 through 6) which is housed in either or both of the recesses 72, 73 in the closed or transport position of the portable display case 10, as is most apparent from FIG. 6, or the header 80 is placed in spanning relationship (FIGS. 4 and 5) to the panel members 12, 13 in the display position of the portable display case 10. The header-receiving recesses 72, 73 each include a respective relatively straight edge 74, 75 interrupted by generally C-shaped or U-shaped edges 76, 77 and 78, 79, respectively. Arcuate edges 91, 92 of the header-receiving recesses 12, 13, respectively, are opposite the generally straight edges 74, 75 and each is interrupted by two finger-receiving recesses 93, 94 and 95, 96, respectively (FIG. 8). As is most apparent from FIG. 6, the finger-receiving recesses 93 through 96 each accommodate a person's finger to facilitate the removal of the header 80 from either of the recesses 72, 73, as is most readily apparent from FIG. 6 of the drawings. The latter might be necessary because each of the straight edges 74, 75 and/or the arcuate edges 91, 92 includes a pair of identical retaining lips 101, 102 and 103, 104 (FIGS. 6 and 8) beneath which an arcuate edge 81 and an opposite straight edge 89 of the header 80 snap-engages (FIGS. 6 and 8) for retention in the header-receiving recesses 72, 73.

The header 80 also includes two projections 82, 83 (FIGS. 4 and 6) which seat in the C-shaped or U-shaped edges or recesses 76, 77 and/or 78, 79. The projections 82, 83 are inserted into upwardly opening slots 112, 113 (FIGS. 4 through 6) opening upwardly through the upper edges 31, 41 of the respective panel members 12, 13. As is most readily apparent from FIG. 4 of the drawings, the header 80 is of a length substantially corresponding to the distance between the pivot axes P1, P3 and thus corresponds in length to twice the distance between the edges 33, 34 and/or 43, 44. Thus, the overall vertical distance between the edges 31, 32 and/or 41, 42 is slightly greater than the length of the header 80 to permit the formation of the header-receiving recesses 72, 73 within the vertical overall height of the central panel members 12, 13. In other words, the overall length of the header 80 corresponds substantially to the overall length of the header-receiving recesses 72, 73 (as measured vertically in FIG. 5) which in turn is substantially that of the vertical heights of the panels 12, 13, again as measured between the edges 31, 32 and 41, 42, respectively, while the latter lengths correspond to approximately twice the width of either of the central panels 12, 13, again as measured between the edges 33, 34 and/or 43, 44.

Adjacent each of the finger-receiving recesses 93 through 96 is identical respective central panel latching means 123 through 126. As is best illustrated in FIG. 7, the central panel latching means 123 includes a raised projection 127 and an upwardly directed lip 128. The corresponding latching means 125 includes a like projection (unnumbered) and the latching lip corresponding to the lip 128 projects downwardly, as is shown in FIG. 5. Similarly, the lip (unnumbered) of the latching means 124, 126 project respectively downwardly and upwardly. Accordingly, when the panel members 12, 13 are pivoted to the closed position (FIG. 1), the latching lips 128 of the latching means 123, 125 and 124, 126 snap secure together due to the inherent resilience of the material and can be readily unsnapped for pivoting from the closed position to the open position (FIG. 5).

Figure 9:
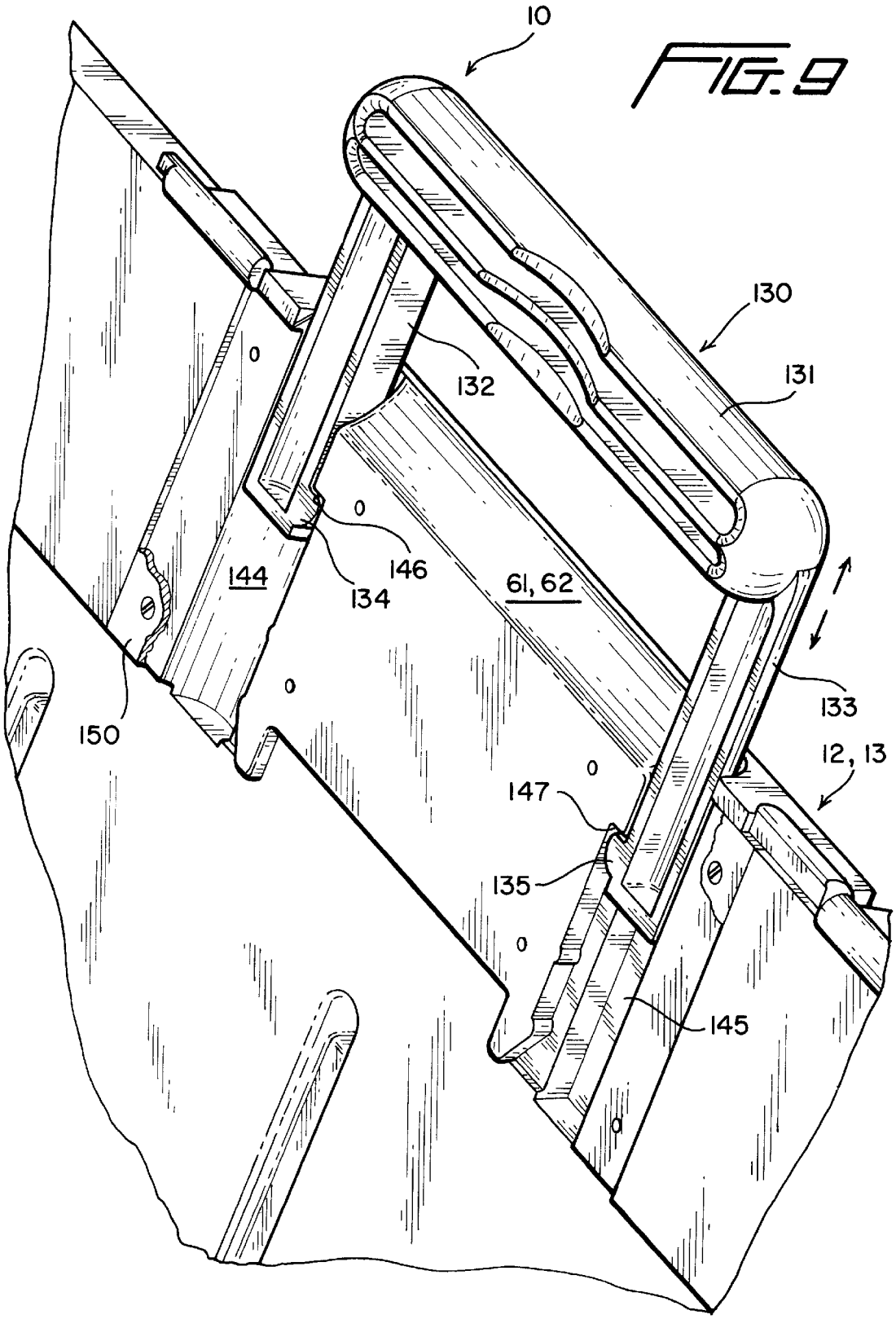
FIG. 9 is a highly enlarged perspective view with parts broken away for clarity of the carrying handle and its associated panel member, and illustrates details of the handle grip, a pair of generally parallel legs, detents carried by the legs, and bores or channels within the panel member for slidably receiving the legs of the carrying handle.

Means of the form of a retractable carrying handle 130 (FIGS. 1 and 9) is provided for carrying the portable display case 10 when in the closed position thereof (FIG. 1). The retractable carrying handle 130 includes a hand grip or gripping handle 131 and a pair of generally parallel legs 132 having respective noses 134, 135 which function to prevent the handle 130 from being totally withdrawn from the associated central panel 112 or 113. More specifically, since the central panels 12, 13 are similarly symmetrically or identically constructed relative to each other, each includes recess means or bores 144, 145 (FIG. 9) into which the legs 132, 133 slide. Each bore 144, 145 includes a respective abutment nose or shoulder 146, 147 (FIG. 9) against which the noses or projections 134, 135 abut when the carrying handle 130 is in its fully extended position, thus preventing further outward movement thereof. A plate 150 is conventionally secured in overlying relationship to the bores 144, 145 of both of the panel members 12, 13 (FIG. 5). The hand grip 131 is, of course, contoured to match the contours of the handle-receiving recesses 61, 62 to fully accommodate therein the hand grip portion 131 in both the closed non-carrying or non-transporting position of the portable display case, as is illustrated in FIG. 2, and in the display position (FIG. 5).

As was noted earlier herein, the panel members 11, 14 are symmetrical to allow interchangeability thereof, and the same is true of the panel members 12, 13 which allows these identical panel members to be molded in a single mold, thereby reducing overall costs of the portable display case 10. In order to achieve such interchangeability, the header/recesses 72, 73 (FIG. 5) are not only identical but are reverse mirror images of each other and each can be exchanged for the other which if done with respect to the display case of FIGS. 4 and 5 would position the lower edges 32, 42 of the respective panel members 12, 13 uppermost and the identical pivoting means 26, 27 and 28 would then snap-secure the side edges 33, 44 of the respective panel members 12, 13 to the side edges 24, 55 of the respective panel members 11, 14. The "bottom" edges 32, 42 of the respective panel members; 12, 13 have recesses 112, 113 (FIG. 5) corresponding to the recesses identically numbered adjacent the upper edges 31, 41, and this allows the header 80 to be inserted in the manner shown in FIG. 5 after the centermost panel members 12, 13 have been "flipped" or "rotated" in the manner just described. Accordingly, the overall cost of the manufacture of the portable display case 10 is appreciably reduced because a single mold is required to mold therein the panel members 12, 13 and a single mold is utilized for molding therein the panel members 11, 14.

Although a preferred embodiment of the invention has been specifically illustrated and described herein, it is to be understood that minor variations may be made in the apparatus without departing from the spirit and scope of the invention, as defined the appended claims.

I claim:

1. A portable display case comprising at least two panel members, means for pivoting said panel members for pivoting movement relative to each other between a closed position in which panel faces of the panel members are in substantially panel face-to-panel face opposing relationship in substantially parallel planes and an open display position in which the panel members are in substantially side-by-side relationship, a carrying handle, and means for effecting reciprocal sliding movement of said carrying handle along a reciprocal path of travel substantially normal to a pivot axis of said pivoting means and adjacent said pivoting means whereby said carrying handle can be slid outwardly beyond said pivoting means and adjacent edges of said panel members in a carrying position and can be slid inwardly to a less obtrusive location in one of said display positions and a closed position of said display case.

2. The portable display case as defined in claim 1 wherein said carrying handle includes a handle grip spanning a pair of legs, and said sliding movement effecting means includes recess means in one of said panel members for slidably receiving therein said pair of legs.

3. The portable display case as defined in claim 1 including means defined by an edge portion of at least one of said panel members adjacent said pivoting means for housing therein said carrying handle in at least one of the closed and display positions thereof.

4. The portable display case as defined in claim 1 wherein said carrying handle includes a handle grip and at least one leg, said sliding movement effecting means includes recess means in one of said panel members for slidably receiving therein said leg, and means defined by an edge portion of at least one of said panel members adjacent said pivoting means for housing therein said carrying handle in at least one of the closed and display positions thereof.

5. The portable display case as defined in claim 1 wherein said carrying handle includes a handle grip spanning a pair of legs, said sliding movement effecting means includes recess means in one of said panel members for slidably receiving therein said pair of legs, and means defined by an edge portion of at least one of said panel members adjacent said pivoting means for housing therein said handle grip in at least one of the closed and display positions thereof.

6. The portable display case as defined in claim 1 including means for limiting the outward projected distance of said carrying handle beyond said pivoting means in the carrying position.

7. The portable display case as defined in claim 1 wherein at least one of said panel faces include means for storing a display element in the closed position.

8. The portable display case as defined in claim 1 wherein at least one of said panel faces include recess means for storing a display element in the closed position.

9. The portable display case as defined in claim 1 wherein at least one of said panel faces include means for storing a display element in the closed position, and means for releasably retaining the display element in said storing means.

10. The portable display case as defined in claim 1 wherein at least one of said panel faces include recess means for storing a display element in the closed position, and means for releasably retraining the display element in said recess storing means.

11. The portable display case as defined in claim 1 wherein at least one of said panel faces include means for storing a display element in the closed position, and means for snap-securing the display element in said storing means.

12. The portable display case as defined in claim 1 wherein at least one of said panel faces include recess means for storing a display element in the closed position, and means for snap-securing the display element in said recess storing means.

13. The portable display case as defined in claim 1 wherein at least one of said panel faces include means for storing a display header in the closed position.

14. The portable display case as defined in claim I wherein at least one of said panel faces include recess means for storing a display header in the closed position.

15. The portable display case as defined in claim 1 wherein said two panel members each include an upper edge portion, and means for securing a display header to said upper edge portions.

16. The portable display case as defined in claim 1 wherein said two panel members each include an upper edge portion, and means for securing a display header to said upper edge portions in spanning relationship to said pivoting means.

17. The portable display case as defined in claim 1 wherein said two panel members each include an upper edge portion, and means for securing a display header to said upper edge portions in spanning relationship to said pivoting means and in a plane substantially parallel to said parallel planes of said panel members in the closed position thereof.

18. The portable display case as defined in claim 1 including means for defining a storage recess in each of said panel faces, said storage recesses being of substantially similar peripheral outline, and said storage recesses being in substantially peripherally opposing relationship in said closed position of said panel members thereby defining a single substantially closed storage recess in said panel members closed position.

19. The portable display case as defined in claim 1 including means for defining a storage recess in each of said panel faces, said storage recesses being of substantially similar peripheral outline, said storage recesses being in substantially peripherally opposing relationship in said closed position of said panel members thereby defining a single substantially closed storage recess in said panel members closed position, and a display panel housed in said single substantially closed storage recess.

20. The portable display case as defined in claim 2 wherein at least one of said panel faces include means for storing a display element in the closed position.

21. The portable display case as defined in claim 2 wherein at least one of said panel faces include means for storing a display element in the closed position, and means for releasably retaining the display element in said storing means.

22. The portable display case as defined in claim 2 wherein at least one of said panel faces include recess means for storing a display element in the closed position, and means for snap-securing the display element in said recess storing means.

23. The portable display case as defined in claim 2 wherein said two panel members each include an upper edge portion, and means for securing a display header to said upper edge portions.

24. The portable display case as defined in claim 2 including means for defining a storage recess in each of said panel faces, said storage recesses being of substantially similar peripheral outline, and said storage recesses being in substantially peripherally opposing relationship in said closed position of said panel members thereby defining a single substantially closed storage recess in said panel members closed position.

25. The portable display case as defined in claim 2 including means for defining a storage recess in each of said panel faces, said storage recesses being of substantially similar peripheral outline, said storage recesses being in substantially peripherally opposing relationship in said closed position of said panel members thereby defining a single substantially closed storage recess in said panel members closed position, and a display panel housed in said single substantially closed storage recess.

26. The portable display case as defined in claim 20 wherein said two panel members each include an upper edge portion, and means for securing a display element having been removed from said storing means to said upper edge portions.

27. The portable display case as defined in claim 20 wherein said two panel members each include an upper edge portion, and means for securing a display element having been removed from said storing means to said upper edge portions in spanning relationship to said pivoting means.

28. The portable display case as defined in claim 20 wherein said two panel members each include an upper edge portion, and means for securing a display element having been removed from said storing means to said upper edge portions in spanning relationship to said pivoting means and in a plane substantially parallel to said parallel planes of said panel members in the closed position thereof.

29. The portable display case as defined in claim 28 wherein said display element securing means includes a slot in each panel member upper edge portion.

30. A portable display case comprising at least two panel members, means for pivoting said panel members for pivoting movement relative to each other between a closed position in which panel faces of the panel members are in substantially panel face-to-panel face opposing relationship in substantially parallel planes and an open display position in which the panel members can be in substantially side-by-side relationship, at least one of said panel faces including means for storing a display element in the closed position, the other of said panel faces being in overlying closing relationship to said storing means in said panel members closed position, and said display element storing means being a recess.

31. The portable display case as defined in claim 30 wherein a display element is housed in said recess.

32. The portable display case as defined in claim 30 wherein a display element in the form of a display header is housed in said recess.

33. The portable display case as defined in claim 30 including a display header housed in said recess.

34. The portable display case as defined in claim 30 including a display header housed in said recess, and means for securing said display header to upper edge portions of said panel members in the open position thereof.

35. The portable display case as defined in claim 34 wherein said recess includes recess portions spaced from each other a distance corresponding to the distance between said securing means along said upper edge portions and along said display header.

36. The portable display case as defined in claim 34 wherein said securing means includes a pair of projections of said header and a pair of openings along said upper edge portion.

37. The portable display case as defined in claim 36 wherein the distance between said pair of projections corresponds substantially to the distance between said pair of openings when said panel members are in the open position thereof.

38. The portable display case as defined in claim 37 wherein said recess includes recess portions spaced from each other a distance corresponding substantially to the distance between said pair of projections for accommodating the same therein.

39. A portable display case comprising at least two panel members, means for pivoting said panel members for pivoting movement relative to each other between a closed position in which panel faces of the panel members are in substantially panel face-to-panel face opposing relationship in substantially parallel planes and an open display position in which the panel members can be in substantially side-by-side relationship, at least one of said panel faces including means for storing a display element in the closed position, the other of said panel faces being in overlying closing relationship to said storing means in said panel members closed position, and said other panel face including means for storing a display element in the closed position.

40. The portable display case as defined in claim 39 wherein said last-mentioned storing means is a recess.

41. A portable display case comprising at least two panel members, means for pivoting said panel members for pivoting movement relative to each other between a closed position in which panel faces of the panel members are in substantially panel face-to-panel face opposing relationship in substantially parallel planes and an open display position in which the panel members can be in substantially side-by-side relationship, at least one of said panel faces including means for storing a display element in the closed position, the other of said panel faces being in overlying closing relationship to said storing means in said panel members closed position, said other panel face including means for storing a display element in the closed position, and said first-mentioned and last-mentioned storing means each including a first and a second recess, respectively.

42. The portable display case as defined in claim 40 wherein said first and second recesses are substantially identically peripherally contoured, and said recesses are in substantially peripherally matching relationship in said closed position of said panel members thereby defining a single substantially closed storage recess in said panel members closed position.

43. The portable display case as defined in claim 42 including a display element in the form of a display header housed in said single substantially closed storage recess.

44. The portable display case as defined in claim 43 including means for securing said display header to upper edge portions of said panel members in the open position thereof.

45. A portable display case comprising at least two panel members; each panel member having upper and lower substantially parallel edge portions and first and second substantially parallel side edge portions, means for pivoting said panel members together substantially along said first side edge portions for movement relative to each other between a closed position in which panel faces of the panel members are in substantially panel face-to-panel face opposing relationship in substantially parallel planes and an open display position in which said second side edge portions are in remote spaced relationship to each other, the length of each upper and lower edge portion being substantially one-half the distance between said upper and lower edge portions, means in one of said panel faces for storing a display element, said storing means having a length corresponding to substantially twice said one-half distance, a display element corresponding in length to twice said one-half distance stored by said storage means, and means for securing said display element upon removal from said storage means in bridging relationship across and to said upper edge portions in said open display position whereby said display element substantially spans the distance between said second side edge portions in said display position.

46. The portable display case as defined in claim 45 wherein said display element storing means is a recess.

47. The portable display case as defined in claim 45 wherein a display element is housed in said storing means.

48. The portable display case as defined in claim 45 wherein a display element in the form of a display header is housed in said storing means.

49. The portable display case as defined in claim 45 where another of said panel faces includes means for storing a display element in the closed position.

50. The portable display case as defined in claim 45 wherein another of said panel faces includes means for storing a display element in the closed position, and said first-mentioned and last-mentioned storing means each include a first and a second recess respectively.

51. The portable display case as defined in claim 50 wherein said first and second recesses are substantially identically peripherally contoured, and said recesses are in substantially peripherally matching relationship in said closed position of said panel members thereby defining a single substantially closed storage recess in said panel members closed position.

52. The portable display case as defined in claim 51 including a display element in the form of a display header housed in said single substantially closed storage recess.

53. The portable display case as defined in claim 52 including means for securing said display header to upper edge portions of said panel members in the open position thereof.

54. The portable display case as defined in claim 45 including third and fourth panel members; said third and fourth panel members each having upper and lower substantially parallel edge portions and first and second substantially parallel side edge portions, and second and third means for pivoting first and second of said two panel members to said respective third and fourth panel members substantially along said second side edge portion of said first and second panel members whereby said third and fourth panel member are in substantially spaced parallel relationship to each other in said closed position with said first and second panel ember sandwiched therebetween.

55. A portable display case comprising at least first, second, third and fourth panel members; each panel member having upper and lower substantially parallel edge portions and first and second substantially parallel side edge portions, first pivot means for pivoting said first and second panel members together substantially along said first and second panel members first side edge portions for movement relative to each other between a closed position in which panel faces of said first and second panel members are in substantially panel face-to-panel face opposing relationship in substantially parallel planes and an open display position in which said first and second panel members second side edge portions are in remote relationship to each other; second pivot means for pivoting said first and third panel members together substantially along said first and third panel second and first side edge portions respectively for movement relative to each other between said closed and open positions; third pivot means for pivoting said second and fourth panel members together substantially along said second and fourth panel second and first side edge portions respectively for movement relative to each other between said closed and open positions, said third and fourth panel members being in panel face-to-panel face relationship to said respective first and second panel members in said closed position with said first and second panel members being substantially sandwiched therebetween, and means at said third and fourth panel respective first and second edge portions for releasably securing said panel members in said closed position in substantially parallel planes.

56. The portable display case as defined in claim 55 including means defined between and by two of said panel members in the closed position thereof for storing a display element.

57. The portable display case as defined in claim 55 including means defined between and by two of said panel members in the closed position thereof for storing a display header.

58. The portable display case as defined in claim 55 including recess means defined between and by two of said panel members in the closed position thereof for storing a display element.

59. The portable display case as defined in claim 55 including first and second recess means in respective one and another of said first through fourth panel members for housing therein a display element, said first and second recess means are substantially of the same peripheral outline, and said first and second recess means are in substantially peripherally aligned opposing relationship in the closed position to collectively house a display element therein.

60. The portable display case as defined in claim 55 including first and second recess means in respective one and another of said first through fourth panel members for housing therein a display element, said first and second recess means are substantially of the same peripheral outline, said first and second recess means are in substantially peripherally aligned opposing relationship in the closed position to collectively house a display element therein, and said display element is a display header.

61. The portable display case as defined in claim 55 including first and second recess means in respective one and another of said first through fourth panel members for housing therein a display element, said first and second recess means are substantially of the same peripheral outline, said first and second recess means are in substantially peripherally aligned opposing relationship in the closed position to collectively house a display element therein, said display element is a display header, and means for securing said display header in spanning relationship to said first and second panel member upper edges.

62. The portable display case comprising at least four panel members, said four panel members including two centermost panel members and two outermost panel members, pivot means connecting said panel members to each other for pivoting movement about three generally parallel pivot axes for moving the panel members between a closed position in which the panel faces of the panel members are in substantially panel face-to-panel face opposing relationship in parallel planes and an open display position in which the panel members are in substantially side-by-side relationship, said centermost panels being of a substantially identical construction, said outermost panel members being of a substantially identical construction, the pivot means between each outermost panel member and each centermost panel member being of a substantially identical construction whereby at least one of said centermost panel members are interchangeable one with the other and said outermost panel members are interchangeable one with the other, and said outermost panel members including asymmetrically arranged latching means.

63. The portable display case as defined in claim 62 wherein said centermost panel members include means at upper and lower edges thereof for securing a header in spanning relationship thereto irrespective of the orientation of said centermost panels.

64. The portable display case as defined in claim 62 wherein said centermost panel members each include a header receiving recess disposed in mirror relationship to each other whereby said header receiving recesses define a single recess in the closed position of said display case.

65. The portable display case as defined in claim 62 including latching means carried by said centermost panel members for cooperatively latching said centermost panel members together in the closed position of said portable display case.

66. A portable display case comprising at least first, second, third and fourth panel members; each panel member having upper and lower substantially parallel edge portions and first and second substantially parallel side edge portions, first pivot means for pivoting said first and second panel members together substantially along said first and second panel members first side edge portions for movement relative to each other between a closed position in which panel faces of said first and second panel members are in substantially panel face-to-panel face opposing relationship in substantially parallel planes and an open display position in which said first and second panel members second side edge portions are in remote relationship to each other, second pivot means for pivoting said first and third panel members together substantially along said first and third panel second and first side edge portions respectively for movement relative to each other between said closed and open positions; third pivot means for pivoting said second and fourth panel members together substantially along said second and fourth panel second and first side edge portions respectively for movement relative to each other between said closed and open positions, said third and fourth panel members being in panel face-to-panel face relationship to said respective first and second panel members in said closed position with said first and second panel members being substantially sandwiched therebetween, means for releasably securing said panel members in said closed position in substantially parallel planes, and means defined between and by two of said panel members in the closed position thereof for storing a display element.

67. The portable display case as defined in claim 66 including a display element stored in said storing means.

68. The portable display case as defined in claim 66 including a display element stored in said storing means, and said display element is a display header.

69. A portable display case comprising at least first, second, third and fourth panel members; each panel member having upper and lower substantially parallel edge portions and first and second substantially parallel side edge portions, first pivot means for pivoting said first and second panel members together substantially along said first and second panel members first side edge portions for movement relative to each other between a closed position in which panel faces of said first and second panel members are in substantially panel face-to-panel face opposing relationship in substantially parallel planes and an open display position in which said first and second panel members second side edge portions are in remote relationship to each other; second pivot means for pivoting said first and third panel members together substantially along said first and third panel second and first side edge portions respectively for movement relative to each other between said closed and open positions; third pivot means for pivoting said second and fourth panel members together substantially along said second and fourth panel second and first side edge portions respectively for movement relative to each other between said closed and open positions, said third and fourth panel members being in panel face-to-panel face relationship to said respective first and second panel members in said closed position with said first and second panel members being substantially sandwiched therebetween, means for releasably securing said panel members in said closed position in substantially parallel planes, first and second recess means in respective one and another of said first through fourth panel members for housing therein a display element, said first and second recess means being substantially of the same peripheral outline, and said first and second recess means being in substantially peripherally aligned opposing relationship in the closed position to collectively house a display element therein.

70. The portable display case as defined in claim 69 wherein said display element is a display header.

71. The portable display case as defined in claim 70 including means for securing said display header in spanning relationship to said first and second panel member upper edges.

* * * * *